US007737649B2

(12) United States Patent
Hösel

(10) Patent No.: US 7,737,649 B2
(45) Date of Patent: Jun. 15, 2010

(54) APPARATUS ON A SPINNING ROOM MACHINE FOR MONITORING AN ELECTRIC DRIVE MOTOR

(75) Inventor: Fritz Hösel, Mönchengladbach (DE)

(73) Assignee: Trützchler GmbH & Co. KG, Mönchenglabach (DE)

( * ) Notice: Subject to any disclaimer, the term of this patent is extended or adjusted under 35 U.S.C. 154(b) by 363 days.

(21) Appl. No.: 11/802,721

(22) Filed: May 24, 2007

(65) Prior Publication Data

US 2007/0273318 A1 Nov. 29, 2007

(30) Foreign Application Priority Data

May 24, 2006 (DE) ..... 10 2006 024 892

(51) Int. Cl.
*H02P 6/12* (2006.01)

(52) U.S. Cl. ..... 318/400.15; 318/98; 318/400.07; 318/434

(58) Field of Classification Search ..... 361/31; 318/400.15, 400.7, 98, 434
See application file for complete search history.

(56) References Cited

U.S. PATENT DOCUMENTS 4,394,606 A * 7/1983 Woerwag ..... 318/434
4,922,579 A 5/1990 Varga
5,152,033 A 10/1992 White
6,705,717 B1 * 3/2004 Fujita et al. ..... 347/106
7,417,400 B2 * 8/2008 Takeishi et al. ..... 318/599
2005/0229362 A1 10/2005 Bocht

FOREIGN PATENT DOCUMENTS

DE 37 08 211 C2 9/1988
DE 10 2004 004 433 A1 8/2005
EP 0 043 815 1/1982
GB 1 594 432 7/1981

OTHER PUBLICATIONS

German Search Report, issued in Application No. 10 2006 024 892.9, dated Apr. 25, 2006.
United Kingdom Search Report, issued in Application No. GB0709633.2, dated Sep. 19, 2007.

* cited by examiner

*Primary Examiner*—Walter Benson
*Assistant Examiner*—Erick Glass
(74) *Attorney, Agent, or Firm*—Venable LLP; Robert Kinberg; Justine A. Gozzi

(57) ABSTRACT

An apparatus on a spinning room machine, especially a spinning preparation machine, is arranged for monitoring an electric drive motor, which is connected to an electronic speed-setting and/or regulating device, a rotating operating element being connected to the drive motor. In order to monitor the drive motor so that no damage occurs even under different operating conditions, there is a device for automatically determining the loading of the drive motor during operation, which is connected to a device for comparison with pre-set values for the loading, to which there is connected a display and/or switching device which can be supplied with electrical signals in the event of departures.

20 Claims, 6 Drawing Sheets

APPARATUS ON A SPINNING ROOM MACHINE FOR MONITORING AN ELECTRIC DRIVE MOTOR

CROSS REFERENCE TO RELATED APPLICATION

This application claims priority from German Patent Application No. 10 2006 024 892.9 dated May 24, 2006, the entire disclosure of which is incorporated herein by reference.

BACKGROUND OF THE INVENTION

The invention relates to an apparatus on a spinning room machine, especially a spinning preparation machine, for example a flat card, roller card or the like, for monitoring an electric drive motor.

In practice, spinning room machines have rotating operating elements (for example cylinders or lickers-in in the case of a carding machine) which are driven by an electric motor. In order to be able to match their speeds to different operating conditions there are frequently used speed-setting or regulating devices, for example frequency converters. As a rule, the motors are so designed in respect of their output capacity that they correspond to the demands in question plus a certain reserve. Where demands vary in dependence upon the operating situation in question, the motors always need to be dimensioned for the highest possible demands. The same is also true of the speed-setting or regulating devices operating the motors. In operation, those devices are able to deliver significantly more power than would be necessary for the motor in question in normal operation. Such a case arises, for example, when a frequency converter is also employed for the electrical braking of the motor. In that case, the braking current delivered by the frequency converter and required for a serviceable result can easily be twice the nominal motor current. Because, in a normal case, there is no monitoring at all between the speed-setting or regulating devices and the motors, in the case of the arrangement described an increase in the power consumption of the motors, for example triggered by a defective bearing, sluggishness of the entire system or some other form of overloading, becomes apparent only when the maximum current limit of the speed-setting or regulating device is reached or exceeded. In such a case, however, it is generally already too late for the motor, especially because it usually involves overloading that begins slowly and persists over a long period. In most cases, the motor, or other drive elements associated therewith, has by that time already been permanently damaged or destroyed.

SUMMARY OF THE INVENTION

It is an aim of the invention to provide an apparatus of the kind described at the beginning which avoids or mitigates the mentioned disadvantages and which, in particular, monitors the drive motor automatically so that damage does not occur, even in the event of different operating conditions.

The invention provides an apparatus on a textile machine for monitoring an electric drive motor which is connected to an electronic speed-setting and/or regulating device and to which a rotating operating element is connected, comprising:

- a device for automatically determining the loading of the drive motor during operation; and
- a comparison device for comparison of determined loading value with pre-set values for the loading;
- wherein an electrical signal is generatable in the event of departure of a determined value from the pre-set values.

By means of the apparatus according to the invention, the motor loading (e.g. the motor current) at any particular time can be determined in the speed-setting or regulating device, transmitted to a control unit, which may be, for example, the respective electronic machine controller, and, in dependence upon the operating situation in question, known to the controller, checked therein as to whether the loading is within the range of known and pre-set limits. In the event of departures from those limits, error reports are output and/or the motor is switched off or the whole machine is brought to a halt. A particular advantage is that the monitoring of the drive motor takes place automatically. In the case of a speed-controlled or speed-regulated electric motor, the current flowing, for example, from the frequency converters to the motor is preferably monitored in respect of its size and in dependence upon the operating situation in question. Such monitoring is effected by means of software and can be performed both in the machine controller (SPS) and in the respective speed-setting or regulating device. It is possible, in particular, to take account of different operating situations, special operational states and the like. By means of the device according to the invention it is possible inter alia for e.g. overloading, sluggishness and the like to be recognized and specifically indicated and to be reported before further damage occurs. No additional elements are required for the measures taken according to the invention. The advantages of the invention can be achieved exclusively by skilful design of the software.

Preferably, the mechanical loading is determinable. The loading may be determined by any suitable measurement method. Non-limitative examples of suitable measurement methods are measurement of the power consumption; measurement of the torque, for example, on a roller; measurement of the effective output; measurement of the phase shift; measurement of a reduction in the speed of the roller drive motor; measurement of a reduction in the speed of a roller; and measurement of the slip of a belt drive. Advantageously, during operation the loading of the drive motor is automatically determinable and comparable with pre-set values and in the event of departures therefrom a pre-determined response takes place.

The pre-set values may be dependent, for example, upon the particular operational states of the machine. In certain preferred embodiments, the detection of the motor loading can be effected in the associated speed-setting or regulating device. In some embodiments, the evaluation of the motor loading can be effected in the speed-setting or regulating device. In certain other embodiments, the evaluation of the motor loading can be effected in the electronic control system of the machine. Advantageously, the apparatus is so arranged that the limits for the permissible loading of the motors can be matched automatically and in dependence upon the particular operational state of the machine. For example, the comparison device may be arranged to select a first group of pre-set values during normal operation, and second and/or third pre-set values during an acceleration period and/or a run-down period.

In preferred embodiments, when the pre-set loading limits are exceeded, a report message and/or other response is given, for example, switching-off the machine.

In some embodiments, the loading on the motors is determined continuously. In further embodiments, the loading of the motors is determined at pre-set time intervals. If desired, the speed-setting or regulating device and/or the electronic control unit of the machine can be so configured that they are capable of learning, storing and re-using the motor loading for certain operational states or transmitting that motor loading information to other control elements. In some embodiments, the speed-setting and/or regulating device and the electronic control unit of the machine are so configured that they are independently capable of influencing the permissible loading limits for the motor, in dependence upon empirical data. In certain preferred arrangements, all the desired values and limit values for the loading of the motors are determined once and appropriately deposited (stored) in the speed-setting and/or regulating device or the electronic control unit of the machine and can be called up therefrom at any time for the monitoring operation. If desired, the monitoring of the motor as well as the associated drive elements and operating elements can be suspended, for example, during certain operational states. The monitored drive motor may be a motor driving one or more rollers of a textile machine, for example, a carding machine. Thus, the drive motor may drive a speed-regulated and/or speed-controlled roller of a carding machine, for example, the cylinder of the carding machine, or at least one licker-in of a carding machine. In one preferred embodiment, the drive motor is an AC servo motor.

The invention also provides an apparatus on a spinning room machine, especially a spinning preparation machine, for example, a flat card, roller card or the like, for monitoring an electric drive motor, which is connected to an electronic speed-setting and/or regulating device and to which a rotating operating element is connected, wherein there is a device for automatically determining the loading of the drive motor during operation, which is connected to a device for comparison with pre-set values for the loading, to which there is connected a display device and/or switching device, which can be supplied with electrical signals in the event of departures.

Furthermore, the invention provides a method of monitoring an electric drive motor for a rotating operating element of a textile machine, wherein the loading of the drive motor is automatically determined during operation, the loading values so determined are compared with pre-set values for the loading, and in which an electrical signal is generated in the event of departure of a predetermined value from the pre-set values.

DETAILED DESCRIPTION OF CERTAIN PREFERRED EMBODIMENTS

Figure 1:
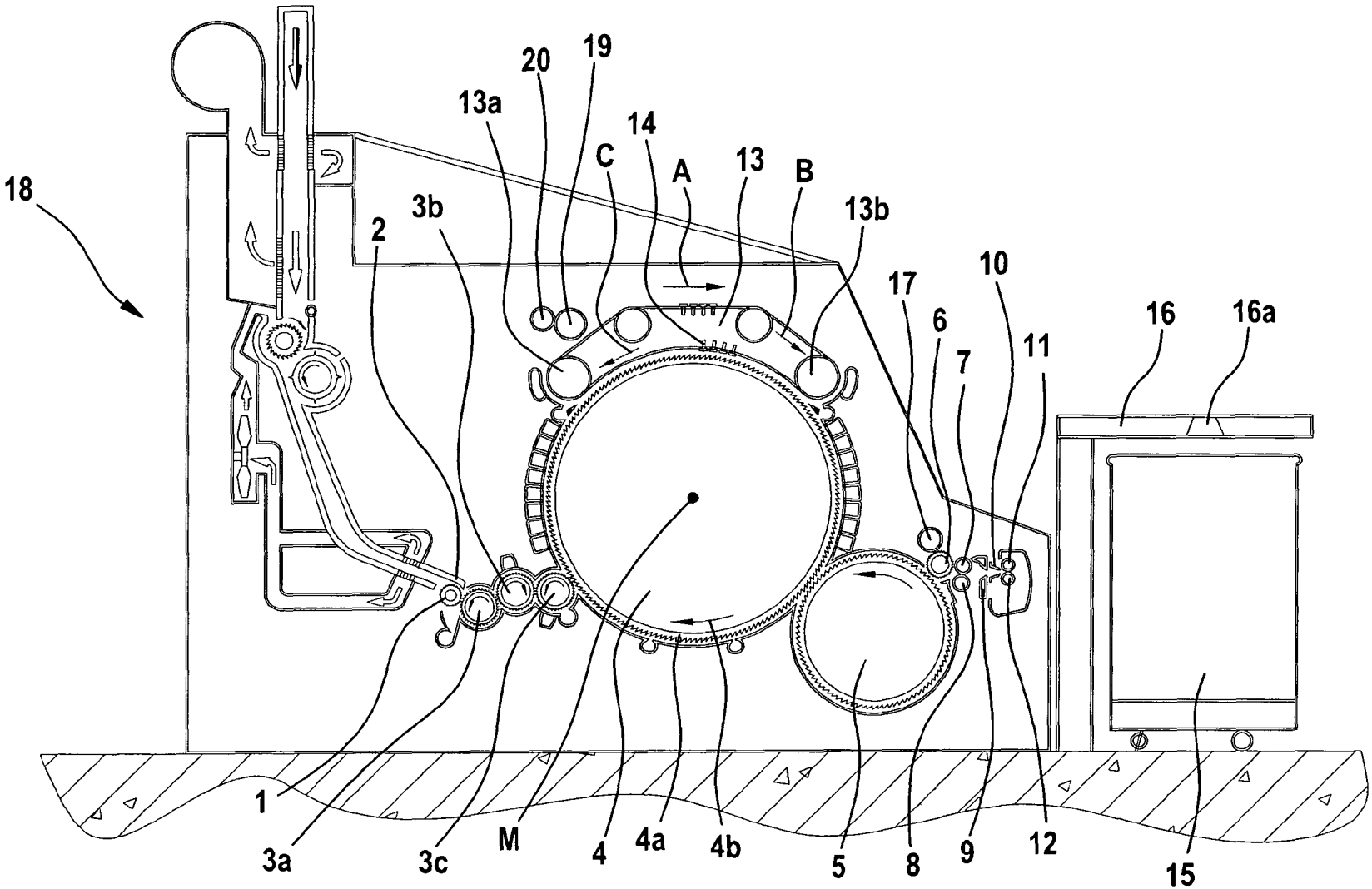
FIG. 1 is a diagrammatic side view of a flat card which incorporate an apparatus according to the invention.

With reference to FIG. 1, a flat card, for example, a TC 03 flat card made by Trützschler GmbH & Co. KG of Mönchengladbach, Germany, has a feed roller 1, feed table 2, lickers-in 3*a*, 3*b*, 3*c*, cylinder 4, doffer 5, stripper roller 6, nip rollers 7, 8, web guide element 10, delivery rollers 11, 12, revolving card top 13 with card top guide rollers 13*a*, 13*b* and flats 14, can 15 and can coiler 16 with coiler plate 16*a*. The directions of rotation of the rollers are indicated by curved arrows. Reference letter M denotes the centre point (axis) of the cylinder 4. Reference numeral 4*a* indicates the clothing and reference numeral 4*b* indicates the direction of rotation of the cylinder 4. Reference letter C indicates the direction of rotation of the revolving card top 13 in the carding position and reference letter B indicates the return transport direction of the flats 14. Reference numeral 17 denotes a cleaning roller for the stripper roller 6 and reference numeral 18 denotes a card feeder.

Figure 2B:
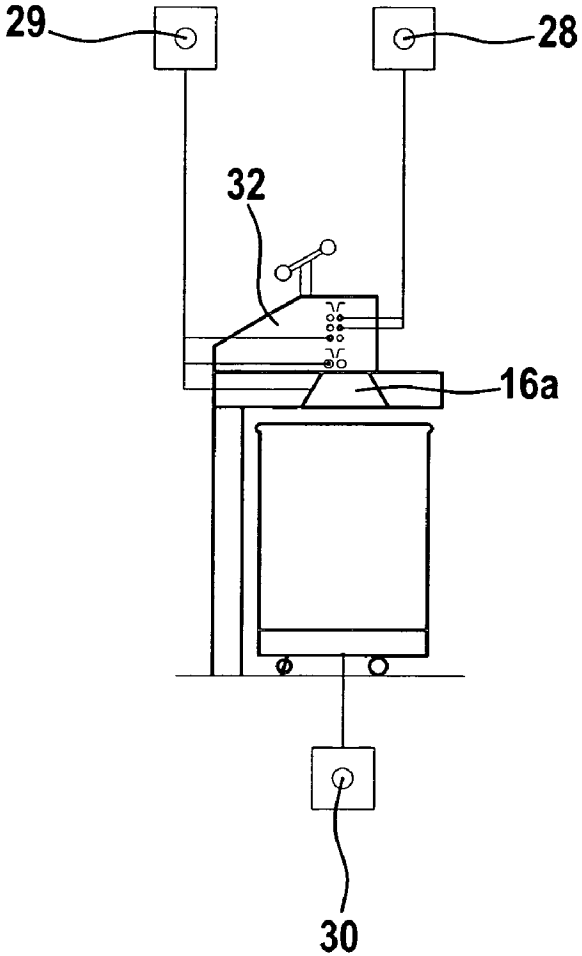
FIG. 2*b* is an operating diagram with drive motors for the can coiler according to FIG. 1 and a card drafting mechanism.
Figure 2A:
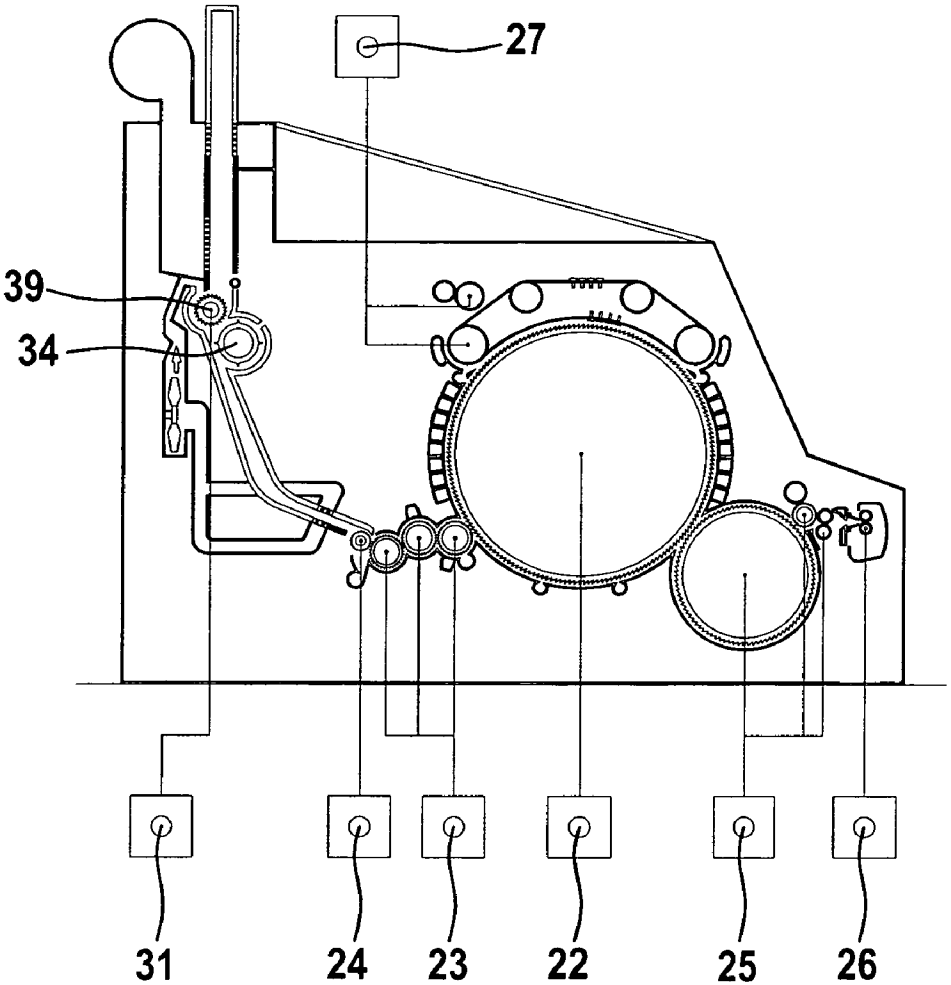
FIG. 2*a* is an operating diagram with drive motors for the flat card, the card feeder and the can coiler according to FIG. 1.

FIG. 2*a* shows an example of a drive concept. Various drive motors and transmission elements together form the drive solution for the flat card TC 03. Special-purpose servomotors drive cylinder 4 and licker-in 3. Maintenance-free special-purpose belts ensure a long service life. The web take-off in the case of the TC 03 is equipped with a separate, regulatable drive. It is thus possible to select the ideal draft for each speed. Even during acceleration and braking, the draft appropriate for the speed at any particular instant is set by the controller. That results in more uniform slivers from the first to the last metre in the can. The motors for the feed roller 1, doffer 5 and web take-off are special-purpose servo drives. There are no high-maintenance gears, for example in the doffer drive. They are brush-less and therefore totally maintenance-free. They are distinguished by very good dynamic properties and thus a load-independent speed variation. As a result, the short-wave uniformity (Uster value) of the card slivers is improved. In the case of an optimum separate set-up of can coiler and changer (see FIG. 2*b*), a servo drive is additionally used.

In the arrangement of FIG. 2*a*, the following rollers are driven by a speed-regulated motor 21, electric drive motor 21, e.g. AC servomotor (AC=alternating current): cylinder 4 by motor 22; lickers-in 3*a*, 3*b*, 3*c* by motor 23; feed roller 1 of the flat card by motor 24; doffer 5, stripper roller 6 and nip rollers 7, 8 by motor 25; delivery rollers 11, 12 by motor 26; rear card top guide roller 13*a* and cleaning roller 19 by motor 27 and intake roller 39 of the card feeder 18 by motor 31. In the can coiler and changer set-up of FIG. 2*b*, the rollers are driven as follows: intake and middle roller pair of the card drafting system 32 by motor 28; output roller pair of the card drafting system 32 as well as delivery rollers and coiler plate 16*a* by motor 29; can rotary plate by motor 30.

Figure 3:
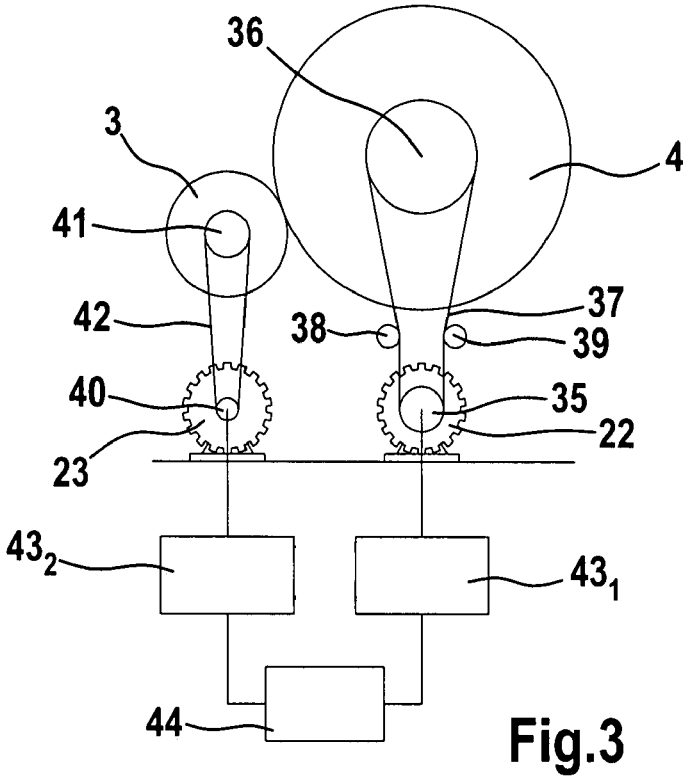
FIG. 3 shows a speed-regulated drive motor for the cylinder and a licker-in of a flat card.

According to FIG. 3, the cylinder 4 is driven by a speed-regulated motor 22 and the licker-in 3 is driven by the speed-regulated motor 23. On the shaft of motor 22 there is arranged a belt pulley 35 and on the shaft of cylinder 4 there is arranged a belt pulley 36, around which an endless belt 37 is looped for drive purposes. The outer side of the belt 37 is in engagement with a guide roller 38 and a tensioning roller 39. On the shaft of the motor 23 there is arranged a belt pulley 40 and on the shaft of the licker-in 3 there is arranged a belt pulley 41, around which an endless belt 42 is looped for drive purposes. The regulated motor 23 is connected electronically to an electronic machine control and regulation device 44 (see FIG. 4) by way of an electronic motor control and regulation device $\mathbf{43}_2$, and the regulated motor 22 is connected electronically to the electronic machine control and regulation device 44 (see FIG. 4) by way of an electronic motor control and regulation device $\mathbf{43}_1$ (see FIG. 4).

Figure 4:
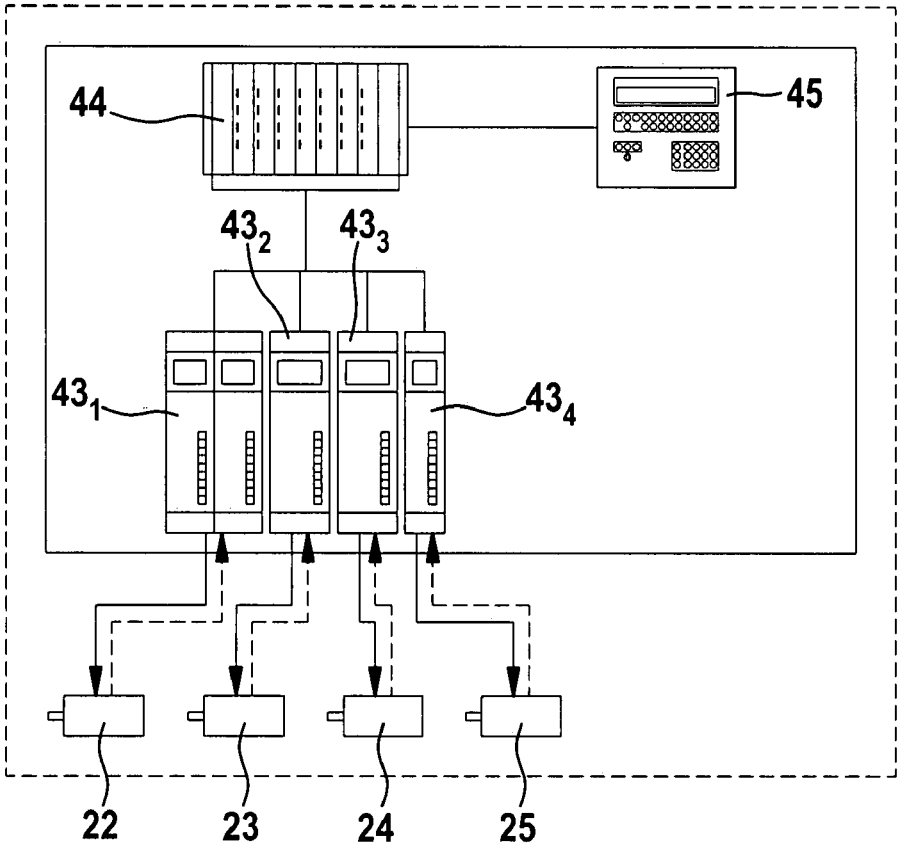
FIG. 4 is a block diagram with an electronic machine control and regulation device, electronic motor control and regulation devices and speed-regulated drive motors of the machine.

FIG. 4 shows a control arrangement with an electronic controller 44, frequency converter 43 and motors 22 to 25. According to FIG. 4, a plurality of motor control and regulation devices $\mathbf{43}_1$, $\mathbf{43}_2$, $\mathbf{43}_3$, $\mathbf{43}_4$, for example servo axle regulators, are present. A drive motor, for example motors 22, 23, 24, 25, is connected to each servo axle regulator $\mathbf{43}_1$, $\mathbf{43}_2$, $\mathbf{43}_3$, $\mathbf{43}_4$, respectively. The servo axle regulators $\mathbf{43}_1$, $\mathbf{43}_2$, $\mathbf{43}_3$, $\mathbf{43}_4$ are connected to the electronic machine control and regulation device 44, for example TMS 2 made by Trüutzschler GmbH & Co. KG. Reference numeral 45 denotes an operating and display unit which is connected to the machine control and regulation device 44.

The speed-regulating device is an integral component of the control and regulation system. Particularly the speed-regulating function of the motor control and regulation devices is employed for the invention.

It is possible for commercially available speed-regulating devices to be used. It is also possible to use servo regulating devices specially matched to the machine. The servo regulating devices can be actuated directly by digital signals via a bus system, for example CANbus. It is operated with feedback of the actual speed value.

Figure 5:
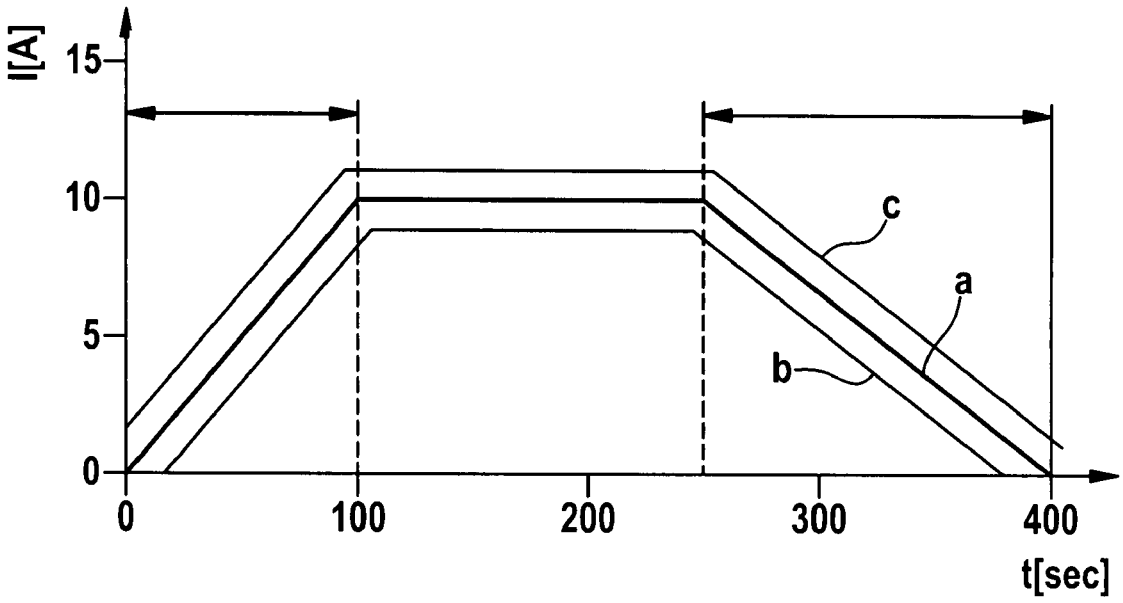
FIG. 5 shows the power consumption of the motor as a function of time or the loading of the motor as a function of different operational states.

FIG. 5 shows the variation in loading and the pre-set loading limits for different operational states. The graph shows diagrammatically the power consumption I (A) over time t (sec). The region with a positive gradient represents the acceleration period, the middle constant region represents operation and the region with a negative gradient represents the run-down period. Reference letter a denotes the desired value, reference letter b denotes a lower limit and reference letter c denotes an upper limit. The limits for the desired loading values are calculated and pre-set as a function of the particular operational state of the machine.

Figure 6:
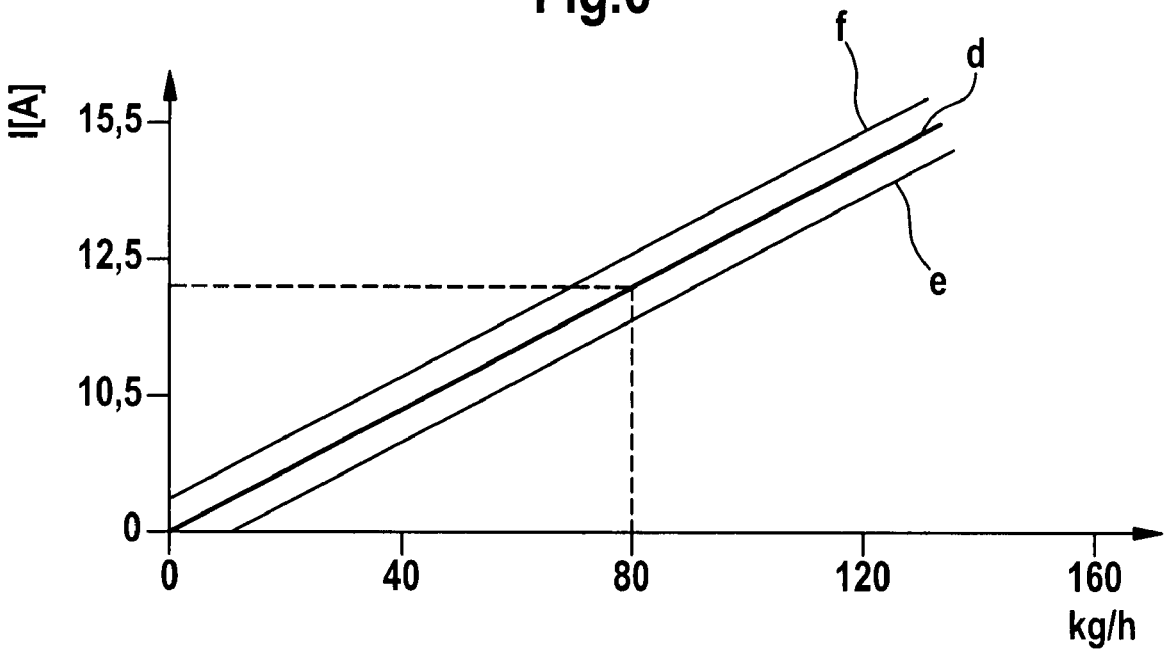
FIG. 6 shows the power consumption of the motor as a function of the amount produced per unit time i.e. the loading of the motor as a function of the production output.

FIG. 6 shows the loading and the associated loading limits as a function of the production rate of a machine. The values for a production rate of 80 kg/h are shown by way of example. The graph shows diagrammatically the power consumption I (A) over production rate (kg/h). Reference letter d denotes the desired value, reference letter e denotes a lower limit and reference letter f denotes an upper limit. The limits for the desired loading values are calculated and pre-set as a function of the particular production rate of the machine.

Figure 7:
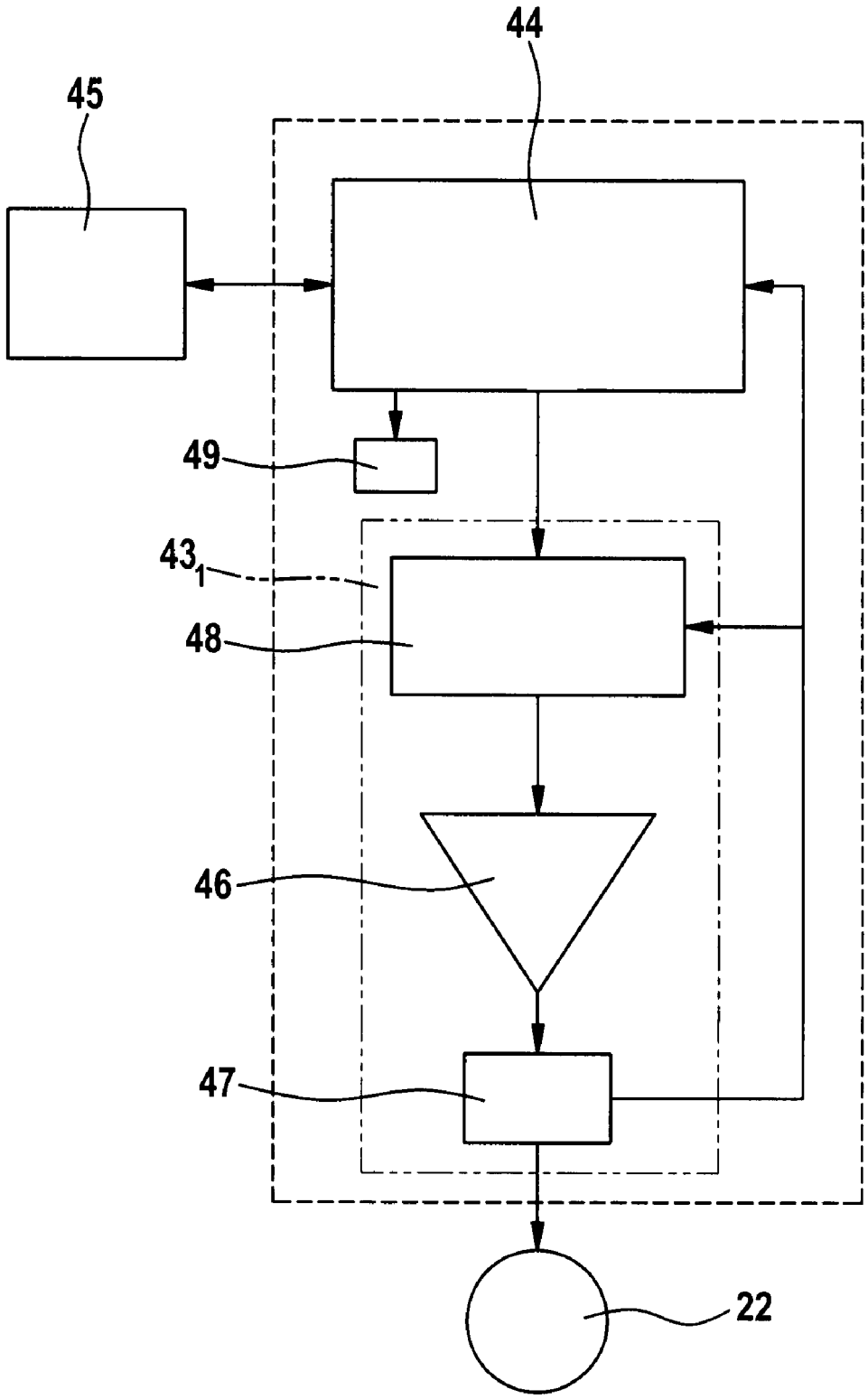
FIG. 7 is a function block diagram of one embodiment of apparatus according to the invention and FIG. 8 shows the variation of the loading and speed as a function of different operational states.

In the embodiment of the invention shown in FIG. 7, the operating and display device 45, a switching device 49, for example a switch-off device, and the motor control and regulation device $\mathbf{43}_1$ (servo axle regulator) are connected to the electronic machine control and regulation device 44. The motor control and regulation device $\mathbf{43}_1$ comprises a speed-regulating or setting device 48, downstream of which there are arranged a power amplifier 46 and a load sensor 47. The load sensor 47 is connected to the motor 22, to the speed-regulating or setting device 48 and the electronic machine control and regulation device 44.

The motor 22 is connected (in a manner not shown) to three phases (L1, L2, L3). The graph I/t according to FIG. 5 shows the power consumption over time. The power consumption I, for example in a supply line, is transformed downwards in a transformer (not shown) and by means of coils. A load sensor 47 converts the input current into a voltage. The varying voltage corresponds to the loading (actual value). The voltage is fed to the speed-regulating or setting device 48 and to the machine control and regulation device 44. In the speed-regulating and setting device 48, the actual value of the loading is compared with the desired value of the loading, which is pre-set by the machine control and regulation device 44. In that way, there is created, in the form of the load sensor 47, a device for automatically determining the loading of the drive motors 21; 22 to 31 during operation, which is connected to the device, in the form of the speed-regulating or setting device 48, for comparison with pre-set values (desired values/limit values) for the loading.

When electric motors 22 to 31 are operated with speed-setting or regulating devices and the output data of motor and device do not exactly correspond, in some cases considerable overloading of the motors can occur. The fact that the output data do not exactly correspond can be quite intentional, and even necessary.

EXAMPLE

A motor is designed for a maximum power output of 7.5 KW. That corresponds to a nominal current of 16 A. It is operated with a frequency converter which can deliver 30 A. If the motor then consumes more power (e.g. 25 A), for example as a result of sluggishness in the drive system, the frequency converter delivers that current without anything being noticed. The consequence would be, however, considerable overloading of the motor. It would become too hot. Accordingly that could possibly even result in permanent damage and ultimately in failure. Those disadvantages are avoided with the apparatus according to the invention.

The regulation and control device can be configured so that it can assume the monitoring of the motor loading independently and in dependence upon operating situation in question. For that purpose, it has suitable means for communication with the electronic control unit of the machine. The speed-setting or regulating device as well as the electronic control unit of the machine can also be configured so that they are independently capable of influencing the permissible loading limits for the motor in dependence upon empirical data.

Figure 8:
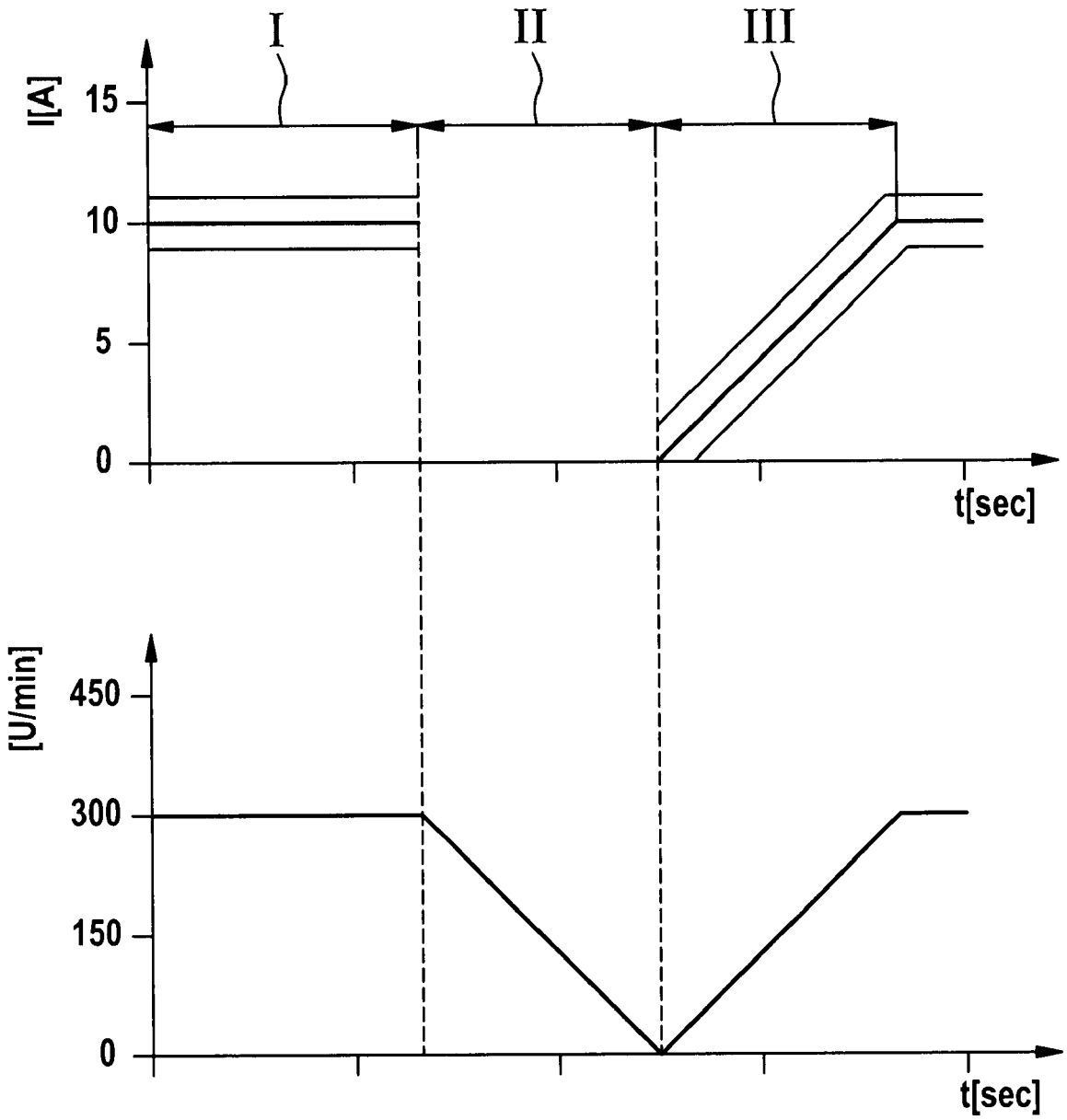

FIG. 8 shows in two graphs the variation in loading and speed as a function of different operational states. The Figure shows inter alia the optional possibility of switching off the monitoring. In certain situations, the monitoring can be switched off for a short period, for example during a braking operation. The monitoring is switched on in region I, switched off in region II and switched on in region III.

The apparatus according to the invention gives rise inter alia to the following advantages:

1. No additional apparatus or modules are required for implementing a system according to the invention.
2. Overloading and the resulting damage to the motors are reliably preventable.
3. Wear or other defects in bearings of the motors or other drive elements connected thereto can be recognised and reported or displayed.
4. Sluggishness can be determined and reported or displayed.
5. When the pre-set lower limits are passed, this indicates, for example, belt breakage or a similar defect.
6. When a problem is recognised, the drive or the entire machine can be brought to a standstill.

Although the foregoing invention has been described in detail by way of illustration and example for purposes of understanding, it will be obvious that changes and modifications may be practised within the scope of the appended claims.

The invention claimed is:

1. A textile spinning room machine, comprising:

a rotatable component;

at least one drive motor, wherein the drive motor is arranged to drive at least the rotatable component in the spinning room machine; and an apparatus for monitoring the drive motor, said apparatus comprising:

a device for automatically determining loading of the drive motor during operation; and a comparison device to compare determined loading values with pre-set values for the loading, wherein an electrical signal is generatable in event of a departure of the determined value from the pre-set values.

2. The machine according to claim 1, wherein the electrical signal is supplied to a display device and/or a switching device.

3. The machine according to claim 1, wherein the loading is determinable.

4. The machine according to claim 1, wherein the loading is determinable by a measurement selected from at least one of a measurement of the power consumption, measurement of torque, measurement of effective output, measurement of the phase shift, measurement of a reduction in the speed of a roller, and measurement of the slip of a belt drive.

5. The machine according to claim 1, wherein, during operation, the loading of the drive motor is automatically determinable and comparable with the pre-set loading values and in the event of departures from the pre-set loading values a report message is generated and/or a pre-determined response takes place.

6. The machine according to claim 5, wherein the response is switching off the machine.

7. The machine according to claim 1, wherein the pre-set values are dependent upon the particular operational states of the machine.

8. The machine according to claim 1, wherein the device for the detection of the motor loading is incorporated in an associated speed-setting and/or regulating device.

9. The machine according to claim 8, wherein the speed-setting and/or regulating device or an electronic control unit of the machine is so configured that it is capable of learning, storing and re-using the motor loading for certain operational states or transmitting that motor loading information to other control elements.

10. The machine according to claim 8, wherein the speed-setting and/or regulating device and an electronic control unit of the machine are so configured that they are independently capable of influencing permissible loading limits for the drive motor, in dependence upon empirical data.

11. The machine according to claim 8, wherein all desired values and limit values for the loading of the drive motor is determined once and appropriately stored in the speed-setting and/or regulating device or an electronic control unit of the machine and are callable therefrom at any time for the monitoring operation.

12. The machine according to claim 1, wherein the comparison device for the motor loading is incorporated in the speed-setting and/or regulating device, or in an electronic control system of the machine.

13. The machine according to claim 1, wherein the comparison device is arranged to select automatically, for the comparison, limits for a permissible loading that are dependent upon a particular operational state of the machine.

14. The machine according to claim 1, wherein the loading on the at least one drive motor is determined continuously.

15. The machine according to claim 1, wherein the loading of the at least one drive motor is determined at pre-set time intervals.

16. The machine according to claim 1, wherein the monitoring of the drive motor as well as the associated drive elements and operating elements are suspendable during certain operational states.

17. The machine according to claim 1, wherein the drive motor is arranged to drive the rotatable component, the rotatable component being a speed-regulated or speed-controlled roller and the textile spinning room machine being a carding machine.

18. The machine according to claim 1, wherein the drive motor is arranged to drive at least two rotatable components.

19. The machine according to claim 1, wherein the drive motor is an AC servo motor.

20. A textile spinning room machine, comprising:

a plurality of rotatable components in the spinning room machine:

two or more drive motors, wherein each drive motor is arranged to drive at least one of the plurality of the rotatable components, wherein each rotatable component is associated with one of the drive motors; and at least one apparatus for monitoring the two or more drive motors, the apparatus comprising:

a device for automatically determining loading of the two or more drive motors during operation; and a comparison device to compare determined loading values with pre-set values for the loading, wherein an electrical signal is generatable in event of a departure of the determined value from the pre-set values.

* * * * *